United States Patent [19]

Thomas et al.

[11] Patent Number: 5,058,813

[45] Date of Patent: Oct. 22, 1991

[54] METHOD FOR COMMINUTING BRITTLE MATERIAL TO BE GROUND

[75] Inventors: Franz Thomas, Oelde-Stromberg; Herbert Weit, Beckum, both of Fed. Rep. of Germany

[73] Assignee: Christian Pfeiffer Maschinenfabrik GmbH & Co. KG, Beckum, Fed. Rep. of Germany

[21] Appl. No.: 455,356

[22] PCT Filed: May 3, 1989

[86] PCT No.: PCT/EP89/00487

§ 371 Date: Feb. 28, 1990

§ 102(e) Date: Feb. 28, 1990

[87] PCT Pub. No.: WO89/10790

PCT Pub. Date: Nov. 16, 1989

[30] Foreign Application Priority Data

May 4, 1988 [DE] Fed. Rep. of Germany ..... 3815217

[51] Int. Cl.[5] ..... B02C 23/10; B02C 23/12

[52] U.S. Cl. ..... 241/19; 241/24; 241/29

[58] Field of Search ..... 241/18, 19, 24, 29

[56] References Cited

U.S. PATENT DOCUMENTS

| | | | |
|---|---|---|---|
| 3,529,778 | 9/1970 | Willmann | 241/24 |
| 4,113,187 | 9/1978 | Hoppen et al. | 241/24 |
| 4,592,512 | 6/1986 | Grigel et al. | 241/24 |
| 4,690,335 | 9/1987 | Allers et al. | 241/24 |
| 4,726,531 | 2/1988 | Strasser | 241/24 |
| 4,783,012 | 11/1988 | Blasczyk et al. | 241/24 |

FOREIGN PATENT DOCUMENTS

| | | |
|---|---|---|
| 0084383 | 7/1983 | European Pat. Off. . |
| 2620463 | 11/1977 | Fed. Rep. of Germany . |
| 3506486 | 8/1986 | Fed. Rep. of Germany . |
| 3609229 | 9/1987 | Fed. Rep. of Germany . |
| 3717976 | 12/1988 | Fed. Rep. of Germany . |

*Primary Examiner*—Timothy V. Eley

*Attorney, Agent, or Firm*—Fleit, Jacobson, Cohn, Price, Holman & Stern

[57] ABSTRACT

The invention relates to a method for comminuting brittle grinding material. An overall economic optimization is required of methods performing only a single grain and material bed comminution in a first comminution stage. According to the invention the first comminution stage comprises precrushing the grinding material with a relatively well defined particle size, so that following stages can be designed for said particle size and consequently it is only necessary to have a lower specific energy requirement per grinding material quantity fed through.

19 Claims, 3 Drawing Sheets

METHOD FOR COMMINUTING BRITTLE MATERIAL TO BE GROUND

The invention relates to a method for comminuting brittle material to be ground according to the preamble of claim 1.

BACKGROUND OF THE INVENTION

Such a continuous method is known from EP 30 09 229 A1. This prior art method in particular aims at improving a comminuting method as described in EP 0 084 383 A1, whereby in the latter method a single grain and material bed comminution takes place. This improvement is in particular that the ground material agglomerates present after material bed comminution undergo disintegration. This seeks to remove the fines contained in the agglomerates by means of a classifying process, so that the overall process can be made more economic, whilst incorporating the following further comminution.

The material bed roller mills conventionally used for simultaneous single grain and material bed comminution have the advantage that they permit relatively fine-grain grinding and particles of 2 mm can be obtained. However, apart from the aforementioned disadvantage of agglomeration, an even greater disadvantage is that coarser ground material particles pass through the material bed roller mill. In addition, compared with other mills or crushers, a material bed roller mill requires relatively high capital costs.

The coarse particles passing through the material bed roller mill make it necessary for the e.g. following comminution by means of a gravity mill and in particular a tube mill to have relatively large diameter grinding elements. Large steel balls are consequently made necessary by the coarse particles passing through a material bed roller mill. In addition, in the case of the tube mill following the material bed roller mill it has been necessary to work with filling levels of approximately 26 to 30%, particularly because on reducing the filling level to e.g. 20%, there is a risk of the relatively coarse steel balls with such a low filling or grinding level shattering the jacket armour plates, as well as the slotted and front plates.

These disadvantageous aspects of the operation of a material bed roller mill and the necessary grinding element size, whilst also taking account of the degree of filling, have led to a comparatively poor efficiency with respect to the overall energy consumption, as in known installations.

SUMMARY OF THE INVENTION

The problem of the present invention is therefore to so further develop the aforementioned method that the specific energy requirement for a specific grinding material quantity is improved and the overall economic aspect is greatly improved by considerably reducing the capital costs, whilst also giving flexible method realization.

The essence of the invention is that the first comminution process of the material to be ground is no longer carried out with a relatively expensive material bed roller mill, but is instead carried out with a primary crusher and in particular a centrifugal crusher. When using such a primary crusher, one deliberately takes account of the fact that the ground material particles leaving the same are not as finely broken up as e.g. in a material bed roller mill. However with the marked reduction in the coarse or oversize material, less very fine material is produced, which would otherwise hinder the comminution of the coarse material by its cushioning action in a second comminution stage. This eliminates the hitherto serious disadvantage that relatively large particles have to be supplied to the following working stages in a fine material bed.

By means of this measure of obtaining a clearly defined feedstock at the primary crusher outlet, but which is not too fine, it is possible in a second comminution stage for which a ball or tube mill with grinding elements is particularly suitable, the diameter of the grinding elements used can be kept smaller, the precomminuted material can be stressed in a planned manner and consequently the degree of filling can be reduced.

Thus, it is e.g. possible in the case of a clearly defined oversize material smaller than 3 mm at the outlet of the centrifugal crusher used as the primary crusher to use in a first chamber of a tube mill e.g. size 40 to 60 steel balls. In the second tube mill chamber it is then possible to use e.g. steel balls in the range 15 to 30 mm. As it is also possible to reduce the degree of filling in a planned manner, there is a greatly reduced energy demand for operating the tube mill. This measure is supplemented by the fact that the oversize material obtained at the tube mill outlet is supplied in cyclic manner to a classifier, whose oversize material is again fed to the tube mill. The fine particle-air mixture at the tube mill outlet can be passed across a following filter, so that the fine particles can be led out together with the fines obtained in the classifying process.

Through the use of smaller diameter grinding elements in the tube mill, there is less wear than necessarily occurs with larger steel balls. The measure of using a centrifugal crusher as the primary crusher, which is in itself inventive and which deliberately moves away from the hitherto held concept of very fine comminution in the first stage and which takes an opposite measure, loads to the advantage of lower capital costs. In addition, a centrifugal crusher requires much less maintenance and is easier to maintain than a material bed roller mill designed with oil hydraulics for producing high pressures. In addition, the invention also makes it possible to obtain a relatively low-level or shallow construction of the plant. This not only leads to a method which is economic from the plant standpoint, but it is also possible to significantly reduce the specific labour and energy costs. On a trial basis, values of 2 to 2.5 kWh/t have been obtained.

On directly supplying the precrushed grinding material into the tube mill as the second comminution stage appropriately the oversize particles of the classifying process are returned to the second comminution stage.

If there is in any case a single grain and material bed comminution, e.g. by means of a material bed roller mill, the material discharged essentially in the form of an agglomerate can additionally be supplied to a following centrifugal crusher for deagglomeration and oversize material comminution, so that it is then available in agglomerate-free form for further treatment.

A further advantage of the method is that no agglomerates are produced during the precomminution in the centrifugal crusher. This permits a problemfree subdivision of the precomminuted material into oversize material and fines (e.g. by classifying). The fines are removed prior to the second comminution stage and consequently the economics of the method are further produced, because no undesired fines pass into the second comminution stage.

It is also particularly advantageous to directly follow the first comminution by a screening process, so that undesired screen oversize can be supplied in a cyclic process to the first comminution stage once again. This ensures that only desired fines are supplied to the ball or tube mill.

BRIEF DESCRIPTION OF DRAWINGS

The invention is described in greater detail hereinafter relative to non-limitative embodiments and the attached drawings, wherein show.

DESCRIPTION OF PREFERRED EMBODIMENTS

Figure 1:
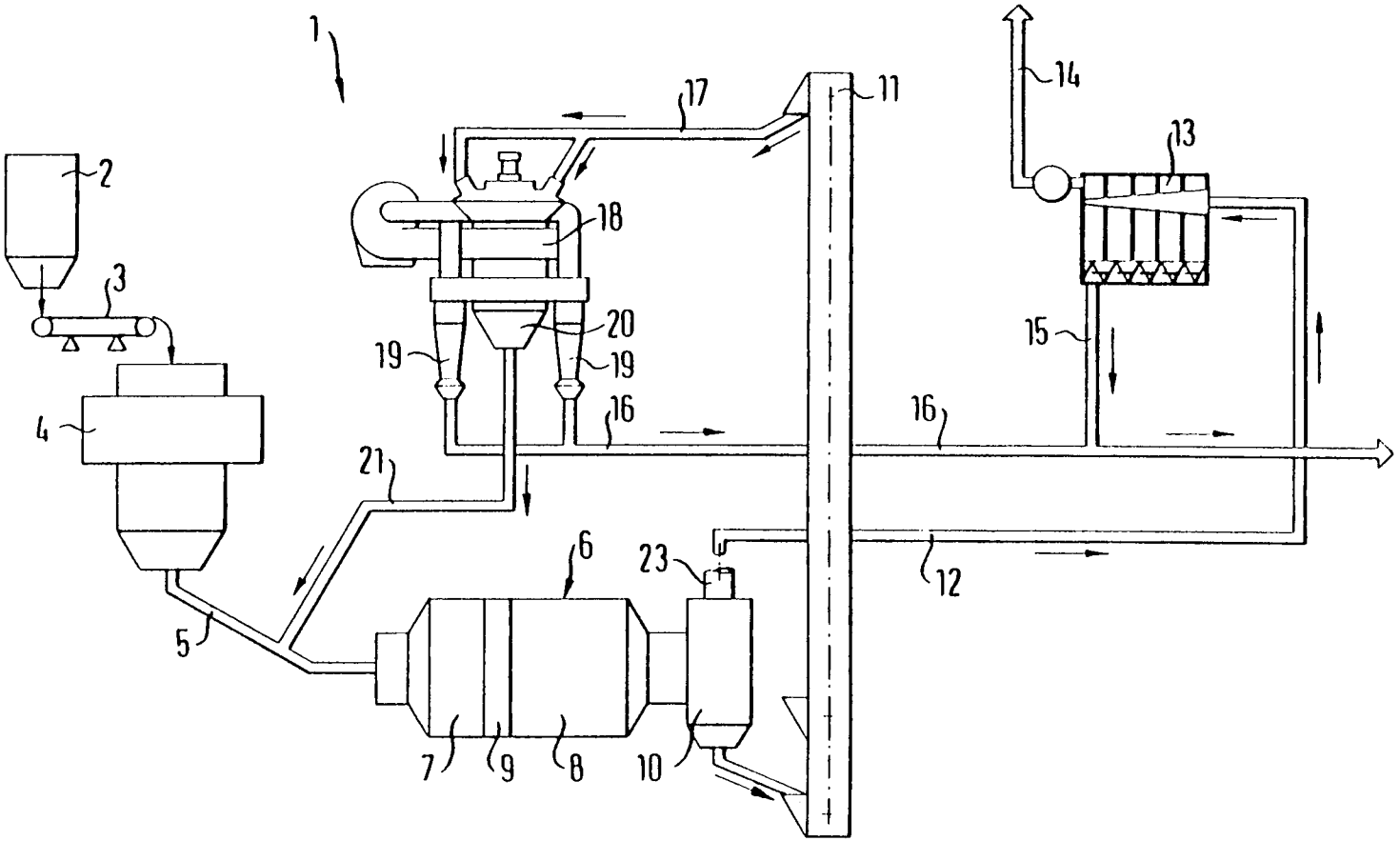
FIG. 1 The basic view of a plant for the continuous comminution of material to be ground, in which following the first comminution stage the material is directly supplied to a second comminution stage.

FIG. 1 diagrammatically shows the process sequence in a preferred alternative. The material to be ground, which can e.g. be cement clinker, is supplied to the overall plant 1 from a feed hopper 2 via a balance 3. By means of the latter it is possible to have a time-metered supply. Following on to the balance 3 the grinding material is supplied to a primary crusher 4, which is preferably a centrifugal crusher.

The material comminuted to a relatively defined adjustable maximum particle size in the centrifugal crusher 4 is, in the embodiment according to FIG. 1, directly passed via line or path 5 into the second comminution stage, which is here designed as a two-chamber tube mill 6. The first chamber 7 of tube mill 6 e.g. has steel balls as grinding elements with diameters in the range 40 to 60 mm. The second chamber 8 connected to the partition 9 is provided with steel balls of 10 to 30 mm and preferably diameters in the range 15 to 30 mm. At the outlet 10 from tube mill 6 the coarse material is passed downwards via a conveying section, which is provided with a bucket elevator 11 and line 17 into a classifier 18. The latter is appropriately a transverse flow classifier, whose oversize material is supplied via the coarse material outlet 20 and line 21 to tube mill 6 as the second comminution stage.

The fine material particles led off at the outlet for the same are drawn off from the process cycle via the removal line 16.

The air-fine particle mixture at outlet 23 of tube mill 6 is supplied via a line 12 to a filter 13, where the fine material particles are separated from the air. The fine material particles are fed via the fine material outlet 15 to the removal line 16, whilst the air is returned via the air outlet 14, optionally into the process circuit.

The grinding material comminuted at the outlet of the relatively inexpensive centrifugal crusher 4 has a clearly defined particle size, where there are few particles larger than the desired size range. This makes it possible to use in the second, following comminution stage for which the two-chamber tube mill is provided to work with smaller diameter steel balls and the filling level of the tube mill can also be below the usual values.

This leads to reduced wear in the tube mill, whilst also reducing energy requirements due to the smaller filling and the reduced overall weight. Compared with the prior art, in which in the first tube mill chamber use is made of size 90 steel balls, it is possible to use grinding elements with a diameter range 40 to 60 mm, which in the second stage can be reduced to 15 to 30 mm.

Figure 2:
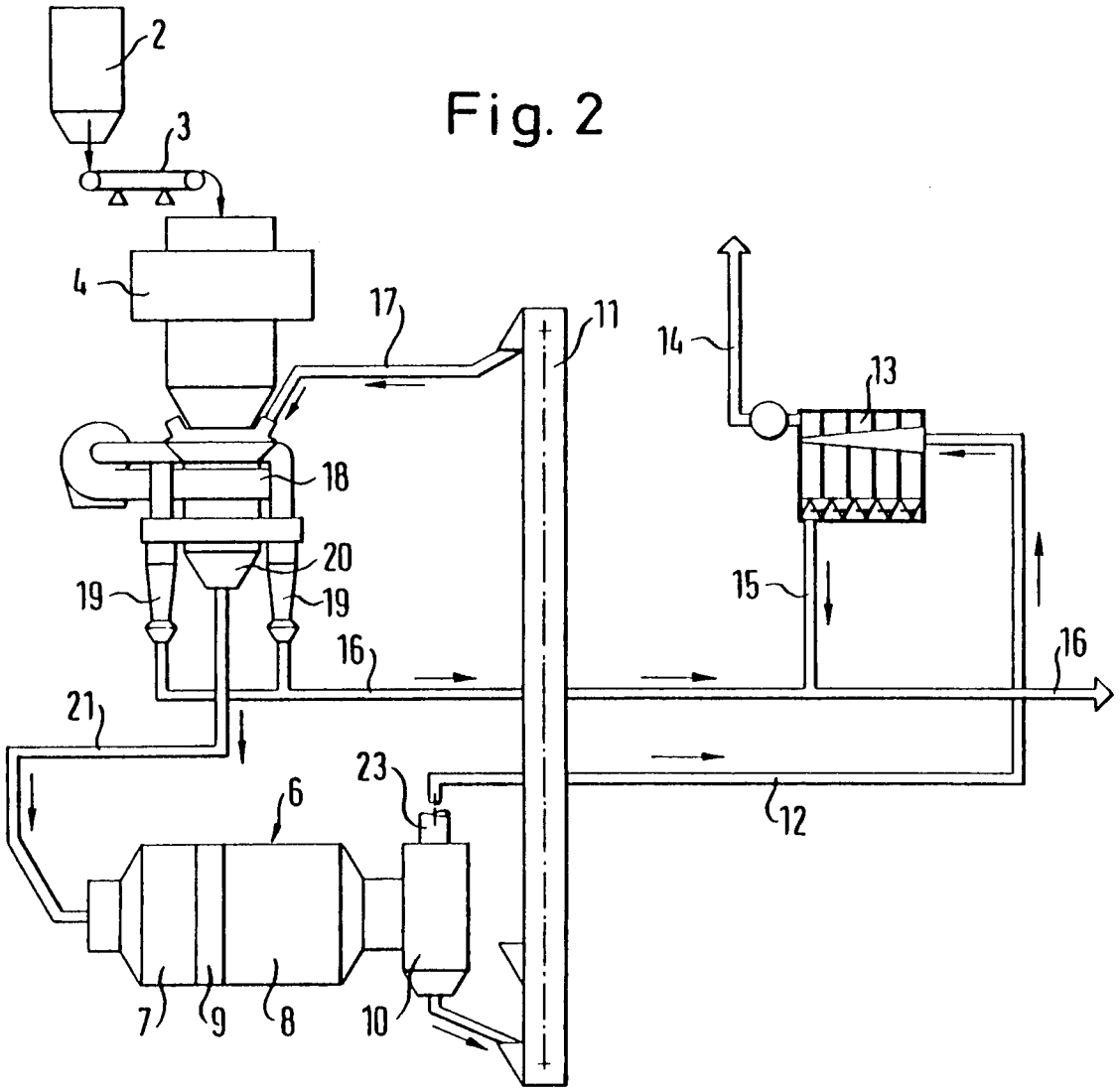
FIG. 2 A process sequence with comparable plant parts to those of FIG. 1, but in which a classifying process is interposed before the second comminution stage.

FIG. 2 shows a variant of the plant according to FIG. 1 for performing the inventive method. The same reference numerals are used to designate the same parts. The difference compared with the embodiment of FIG. 1 is that now the classifier 18 directly follows the centrifugal crusher 4 of the first comminution stage.

As a result the fines can be removed from the process circuit via the fines outlets 19 and are consequently no longer applied to the tube mill 6 as the second grinding material comminution stage. As the throughout of tube mill 6 is reduced, this leads to a further improvement to the efficiency of the overall plant.

In the embodiment according to FIG. 2 the oversize material of classifier 18 is supplied via the coarse material outlet 20 and line 21 in cyclic manner to the tube mill 6, which is equipped with grinding elements as in the embodiment according to FIG. 1.

Figure 3:
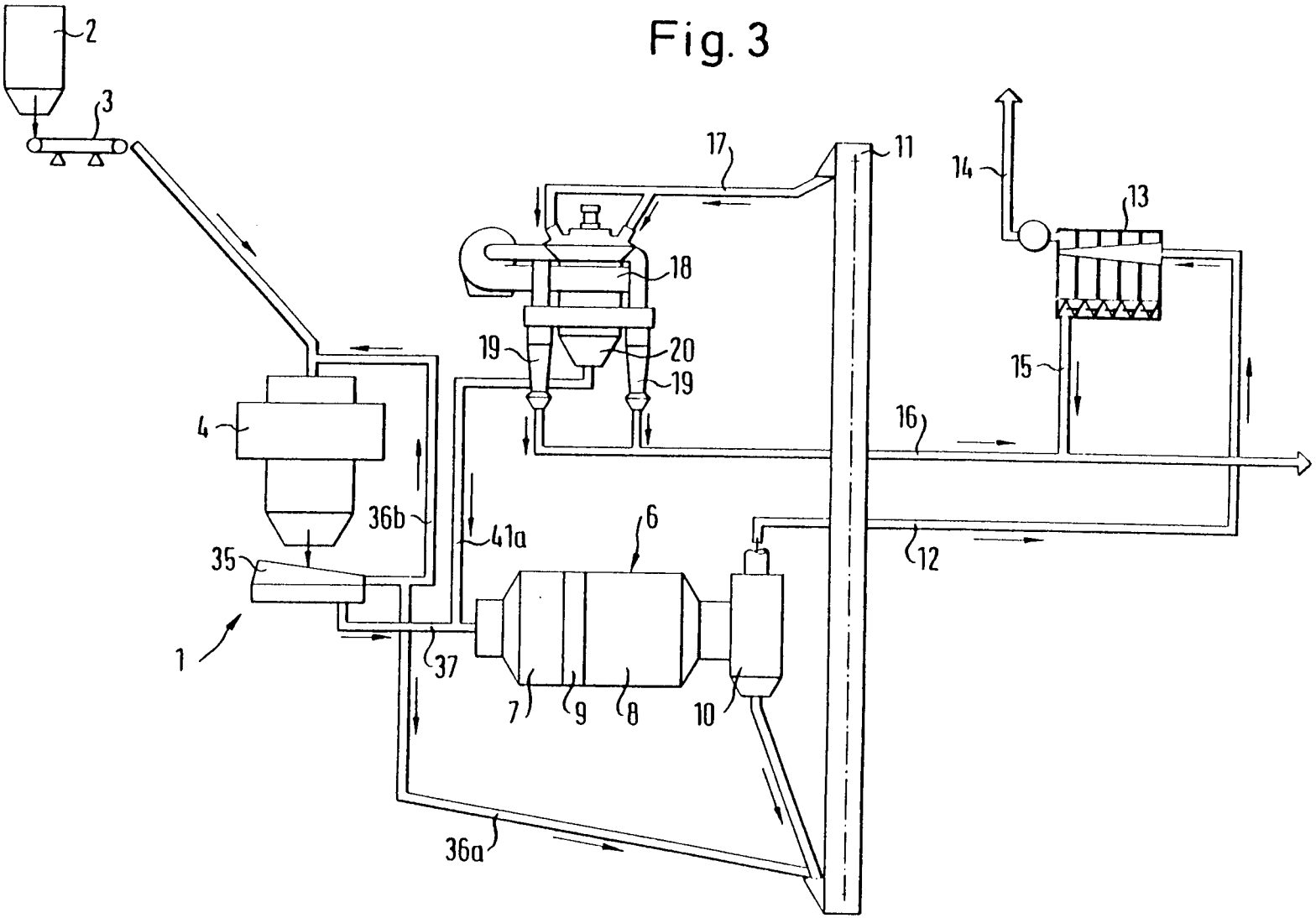
FIG. 3 Another variant of the invention, in which screening is carried out after the first comminution and only the grinding material up to a certain particle size is supplied to the second comminution stage.

FIG. 3 shows another variant of the invention, the same reference numerals designating the same units as hereinbefore. In order to ensure that a precomminuted grinding material is supplied to a particular particle size to the second comminution stage, in the embodiment according to FIG. 3 the precomminution is followed by a screening process. The grinding material leaving the centrifugal crusher 4 is therefore passed through a screen 35. The oversize material in screen 35 either passes via line **36*a* to the bucket elevator 11 and is then returned in cyclic manner, or it is passed via the line 36*b* to the centrifugal crusher. However, the grinding material obtained up to a desired particle size is fed via line 37 to tube mill 6** for further comminution.

In the embodiment according to FIG. 3 the material fed to the bucket elevator 11 enters the classifier 10. The coarse material obtained following the classification process is returned to the second comminution stage 6 via return line **41*a***.

This makes it possible to ensure that no oversize material of the precomminuted grinding material passes into the tube mill 6, so that the second comminution stage can be effected in an optimum manner with respect to the size of the grinding material and the degree of filling.

The field of application of the inventive method does not merely extend to the grinding of cement clinker, but is also usable for comparable materials such as limestone, ores, coal, quartz sand or chippings, these details being only provided in an exemplified manner.

Thus, the inventive method and the plant alternatives provided for it bring about a reduction in the specific energy requirement per grinding material quantity and by reductions in wear this is at least extended to the second comminution stage. The capital costs are also lower than in comparable prior art plants.

I claim:

1. A method for the comminution of brittle material comprising the steps of:

precrushing the brittle material in a first comminuting stage by means of a centrifugal crusher, screening material received from the crusher to provide oversize and undersize particles, comminuting the undersize particles in a second comminuting stage by means of a multistage tube mill so as to provide coarse and fine particles, supplying the course particles to a classifying stage in which the coarse particles are processed to provide further coarse and further fine particles, and mixing the further fine particles from the classifying stage with the fine particles from the second comminuting stage.

2. The method according to claim 1 which includes the step of supplying the further coarse particles from the classifying stage in a cyclic process to the second comminuting stage.

3. A method according to claim 1 wherein the tube mill comprises a two-stage tube mill having a degree of filling of under 26 to 30%, using grinding elements with a diameter in the range of 40 to 60 mm in a first stage of the tube mill and grinding elements of a diameter of 10 to 30 mm in a second stage tube mill.

4. A method according to claim 1 which includes filtering the fine particles from the second comminuting stage.

5. A method according to claim 1 which includes cyclone separating of the fine particles from the second comminuting stage.

6. A method according to claim 1 which includes using a transverse flow classifier in the classifying stage.

7. A method according to claim 1 which includes supplying the oversize particles from the screening in a cyclic process to the first comminuting stage.

8. A method for the comminution of brittle material comprising the steps of:

precrushing the brittle material in a first comminuting stage by means of a centrifugal crusher, supplying prescrushed material from the crusher to a classifying stage, processing the prescrushed material in the classifying stage to provide coarse and fine particles, comminuting the course particles in a second comminuting stage by means of a multistage tube mill to provide further coarse and further fine particles, and mixing the fine particles from the classifying stage with the further fine particles from the second comminuting stage.

9. A method according to claim 8 which includes supplying the coarse particles from the classifying stage in a cyclic process to the second comminuting stage.

10. A method according to claim 8 wherein the tube mill comprises a two-stage tube mill with a degree of filling of under 26 to 30%, using grinding elements with a diameter in the range of 40 to 60 mm in a first stage of the tube mill and grinding elements with a diameter of 10 to 30 mm in a second stage of the tube mill.

11. A method according to claim 8 which includes filtering the further fine particles from the second comminuting stage.

12. A method according to claim 8 which includes cyclone separating the further fine particles from the second comminuting stage.

13. A method according to claim 8 which includes using a transverse flow classifier in the classifying stage.

14. A method for the comminution of brittle material comprising the steps of:

precrushing the brittle material in a first comminuting stage by means of a centrifugal crusher, comminuting material received from the first comminuting stage in a second comminuting stage by means of a multistage tube mill to provide coarse and fine particles, supplying the coarse particles from the second comminuting stage to a classifying stage, processing the coarse particles in the classifying stage to provide further coarse and further fine particles and mixing the further fine particles from the classifying stage with the fine particles from the second comminuting stage.

15. A method according to claim 14 which includes supplying the further coarse particles from the classifying stage in a cyclic process to the second comminuting stage.

16. A method according to claim 14 wherein the tube mill comprises a two-stage tube mill with a degree of filling of under 26 to 30%, using grinding elements with a diameter in the range of 40 to 60 mm in a first stage of the tube mill and grinding elements with a diameter of 10 to 30 mm in a second stage of the tube mill.

17. A method according to claim 14 which includes filtering the fine particles from the second comminuting stage.

18. A method according to claim 14 which includes cyclone separating the fine particles from the second comminuting stage.

19. A method according to claim 14 which includes using a transverse flow classifier in the classifying stage.

* * * * *